US008472853B2

(12) United States Patent
Akamatsu et al.

(10) Patent No.: US 8,472,853 B2
(45) Date of Patent: Jun. 25, 2013

(54) IMAGE FORMING APPARATUS

(75) Inventors: Takaaki Akamatsu, Suntou-gun (JP); Shuichi Tetsuno, Numazu (JP); Masashi Tanaka, Susono (JP); Shogo Kan, Suntou-gun (JP); Kenichi Ogawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 115 days.

(21) Appl. No.: 13/094,057

(22) Filed: Apr. 26, 2011

(65) Prior Publication Data

US 2011/0268482 A1 Nov. 3, 2011

(30) Foreign Application Priority Data

Apr. 30, 2010 (JP) ..... 2010-105346

(51) Int. Cl.
*G03G 15/20* (2006.01)

(52) U.S. Cl.
USPC ..... 399/327

(58) Field of Classification Search
USPC ..... 399/322, 327
See application file for complete search history.

(56) References Cited

U.S. PATENT DOCUMENTS 6,094,559 A * 7/2000 Otsuka et al. ..... 399/327
2009/0257793 A1 10/2009 Yoshioka et al.

FOREIGN PATENT DOCUMENTS

| | | | |
|---|---|---|---|
| JP | 3-58074 | A | 3/1991 |
| JP | 5-158375 | A | 6/1993 |
| JP | 7-129017 | A | 5/1995 |
| JP | 8-152808 | A | 6/1996 |
| JP | 2000-47509 | A | 2/2000 |
| JP | 2000-122463 | A | 4/2000 |
| JP | 2009-271517 | A | 11/2009 |

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image forming apparatus includes an image forming portion for forming an unfixed toner image on a recording material; and a fixing portion for heat-fixing the unfixed toner image on the recording material while nip-conveying the recording material in a fixing nip, the fixing portion includes a first rotatable member contactable to the unfixed toner image, and a second rotatable member contacted to the first rotatable member to form the fixing nip between itself and the first rotatable member. The image forming apparatus is capable of setting a cleaning mode in which the fixing portion is cleaned by a cleaning sheet while nip-conveying the cleaning sheet in the fixing nip. When the cleaning mode is set, the image forming apparatus executes a plurality of types of cleaning operations in a period in which a single cleaning sheet passes through the fixing nip.

10 Claims, 4 Drawing Sheets

(a)

(b)

(a)

(b)

IMAGE FORMING APPARATUS

FIELD OF THE INVENTION AND RELATED ART

The present invention relates to an image forming apparatus such as an electrophotographic copying machine or an electrophotographic printer.

In the image forming apparatus of an electrophotographic type, such as the copying machine or the printer, a fixing device for fixing an unfixed toner image, which has been transferred onto a recording material such as transfer paper or an OHP sheet at an image forming portion, on the recording material is mounted. As a type of the fixing device, a heating roller type including a fixing roller and a pressing roller and a film heating type including a fixing film and the pressing roller have been known. In the fixing device of these types, a pressing member such as the pressing roller is contacted to a rotatable fixing member such as a heated fixing roller or a heated fixing film and the unfixed toner image is heated and melted while nip-conveying the recording material carrying the unfixed toner image, thus being heat-fixed on the recording material. In the fixing device, it is ideal that a whole toner of the unfixed toner image carried on the recording material is heat-melted by the rotatable fixing member to be heat-fixed on the recording material.

However, in the fixing device, with respect to the unfixed toner image, toners such as cold-offset toner which has not been completely melted, hot-offset toner which has been excessively melted and toner remaining on the rotatable fixing member by electrostatic action are deposited on the rotatable fixing member due to various factors. Finally, these toners are deposited, as a contaminant containing paper powder or the like (hereinafter referred to as a toner contaminant), on either one or both of a peripheral surface of the rotatable fixing member and a peripheral surface of the pressing member. Generally, the toner offset on the rotatable fixing member surface is melted together with the unfixed toner image formed on the recording material and then most of the toner is discharged to the outside of the image forming apparatus. However, a part of the toner contaminant left on the surface of the rotatable fixing member is liable to be transferred onto the pressing member surface during a period until a subsequent recording material enters the fixing device (during sheet interval). This is because the pressing member has a lower surface temperature than that of the rotatable fixing member, thus exhibiting a small parting property. When the toner contaminant is once accumulated on the pressing member surface, the parting property of the pressing member surface is further lowered and in some cases, a problem such as a jam occurs by winding of the recording material (particularly such as glossy paper or an OHP sheet) about the pressing member surface. Further, a large amount of the toner contaminant is discharged on an unfixed toner image non-carrying surface (back surface) of the recording material, so that image contamination can occur. For that reason, the surface of many pressing members is subjected to coating with a material having a high parting property such as PFA, thus being prevented from accumulation of the toner contaminant. However, the accumulation of the toner contaminant is not completely prevented.

With respect to the toner contaminant on the pressing member surface, in Japanese Laid-Open Patent Application (JP-A) 2000-047509, a cleaning means for holding a solid white recording material which does not carry the toner image and for conveying the recording material while repeating rotation and stop of the rotation has been proposed.

According to this cleaning means, the toner contaminant on the pressing member surface can be successively transferred onto cleaning paper. In this method, the surface temperature of the pressing member at rest is made not less than a softening point of the toner, so that the toner contained in the toner contaminant deposited on the peripheral surface of the pressing member is melted. As a result, an adhesive force (bonding strength) between the toner contaminant and a solid white recording material on which the toner image is not formed (herein referred to as the cleaning paper) and a permeation of the toner contaminant into the cleaning paper are increased. Thus, the toner contaminant on the pressing member surface can be easily discharged onto the cleaning paper, so that the toner contaminant on the pressing member surface can be efficiently removed. Further, a method in which cleaning paper on which a solid image is formed (printed) on one surface (hereinafter referred to as a cleaning pattern) with a printed surface toward the pressing member surface has also been widely known as a method for removing the toner contaminant from the pressing member.

On the other hand, in the case where the parting property of the rotatable fixing member surface is lower than that of the pressing member surface, a part of the toner contaminant is also deposited and accumulated on the rotatable fixing member surface, so that winding of the recording material about the rotatable fixing member and image contamination are caused.

With respect to the toner contaminant, JP-A Hei 3-58074 discloses a method in which the cleaning paper with the printed solid image on its one surface is passed with the printed surface toward the rotatable fixing member surface. In this method, the surface temperature of the rotatable fixing member is not less than the softening point of the toner, so that the toner contained in the toner contaminant deposited on the rotatable fixing member surface is melted. Further, at the same time, the solid image formed on the cleaning paper is also melted, so that the toner contaminant on the rotatable fixing member surface and the solid image on the cleaning paper are bonded to each other. Thus, the toner contaminant is discharged together with the cleaning paper to the outside of the image forming apparatus. A cleaning effect on the rotatable fixing member by this method is high, so that the cleaning paper is a very effective cleaning means.

As the recording material used in the image forming apparatus in which the above-described fixing device is mounted, a recording material containing a large amount of paper powder or a large amount of a filler such as a calcium carbonate component can be used. In this case, there is a tendency to cause deposition of a paper powder rich toner contaminant, i.e., a contaminant with a photosensitive drum ratio larger than a toner ratio, also on the pressing member surface of the fixing device. When the paper powder rich toner contaminant is accumulated on the pressing member surface, in some cases, the rotatable fixing member surface is abraded (worn) by friction thereof with the photosensitive drum or filler in the toner contaminant to lower the parting property and is damaged. Further, in some cases, an image defect is caused by transfer of the damage from the rotatable fixing member surface onto the unfixed toner image on the recording material. With respect to the cleaning means (cleaning mode) using the cleaning paper for cleaning the rotatable fixing member surface and the pressing member surface, in many cases, the toner contaminant is removed by enlarging a contact are with the cleaning paper by utilizing viscosity of the toner heated up to the toner softening point or more. However, the paper powder and the filler are present in a large amount at a contact surface between the paper powder rich toner contaminant and the cleaning paper and therefore even when the paper powder rich toner contaminant is heated to the toner softening point or more, the softened toner cannot be contacted sufficiently to the cleaning paper. For that reason, the toner contaminant cannot obtain a high adhesive property to the cleaning paper, so that the cleaning effect is reduced.

SUMMARY OF THE INVENTION

A principal object of the present invention is to provide an image forming apparatus capable of removing a contaminant on a peripheral surface of a rotatable fixing member and a contaminant on a peripheral surface of a pressing member at the same time by passing cleaning paper through a nip one time.

According to an aspect of the present invention, there is provided an image forming apparatus comprising:

an image forming portion for forming an unfixed toner image on a recording material; and a fixing portion for heat-fixing the unfixed toner image on the recording material while nip-conveying the recording material in a fixing nip, the fixing portion including a first rotatable member contactable to the unfixed toner image, and a second rotatable member contacted to the first rotatable member to form the fixing nip between itself and the first rotatable member, wherein the image forming apparatus is capable of setting a cleaning mode in which the fixing portion is cleaned by a cleaning sheet while nip-conveying the cleaning sheet in the fixing nip, wherein when the cleaning mode is set, the image forming apparatus executes a plurality of types of cleaning operations in a period in which a single cleaning sheet passes through the fixing nip.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Part (a) of FIG. 1 is a schematic structural view of an example of an image forming apparatus according to Embodiment 1, and (b) of FIG. 1 is a schematic structural view of an example of a fixing device.

Part (a) of FIG. 2 is an illustration showing a toner deformation start point and a toner deformation end point which are measured by a flow tester, and (b) of FIG. 2 is an illustration showing a toner flow start point, a toner softening point and a toner flow end point which are measured by the flow tester.

Figure 3:
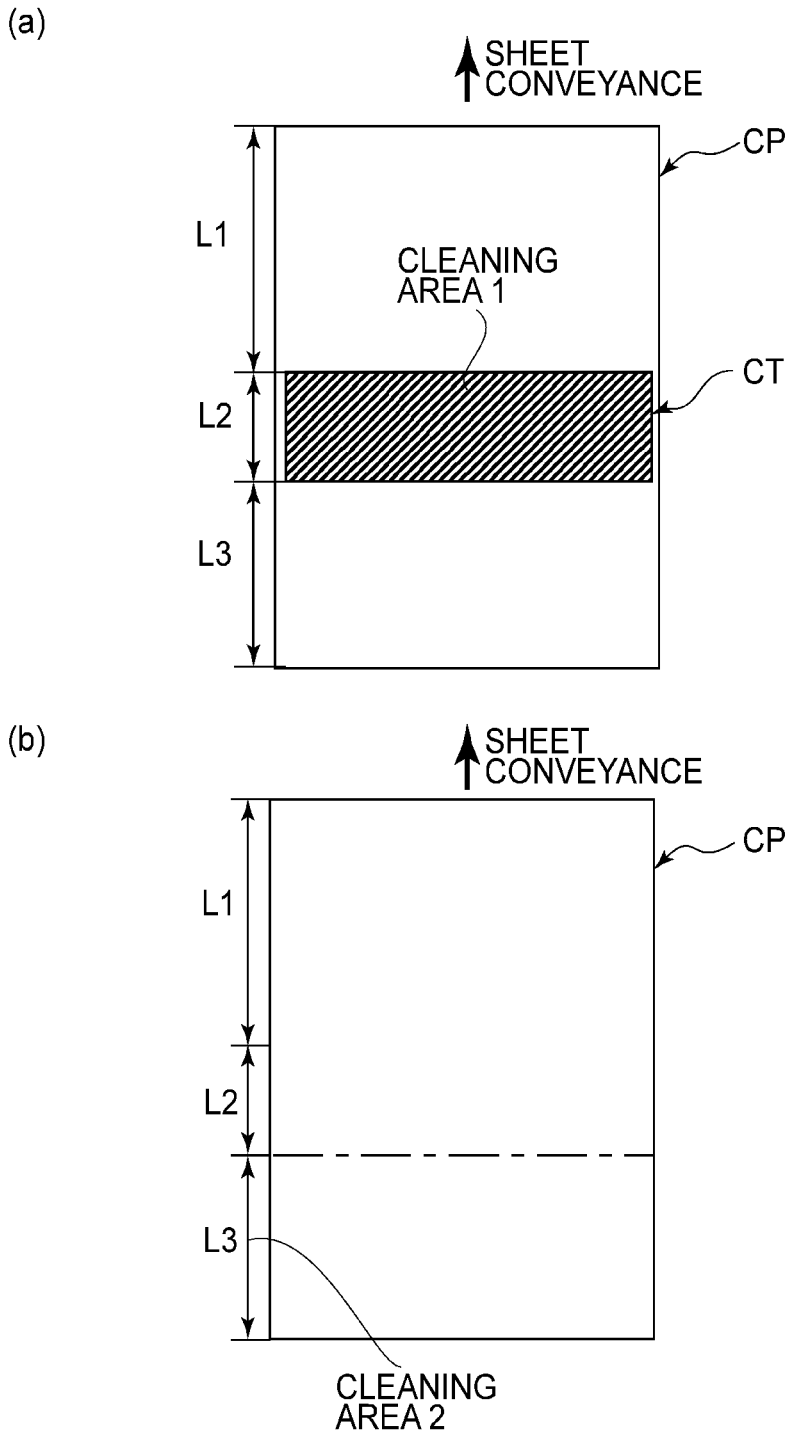

Part (a) of FIG. 3 is a schematic view showing a cleaning area 1 provided on a surface of cleaning paper to be contacted to a fixing film surface, and (b) of FIG. 3 is a schematic view showing a cleaning area 2 provided on a surface of the cleaning paper to be contacted to a pressing roller surface.

Figure 4:
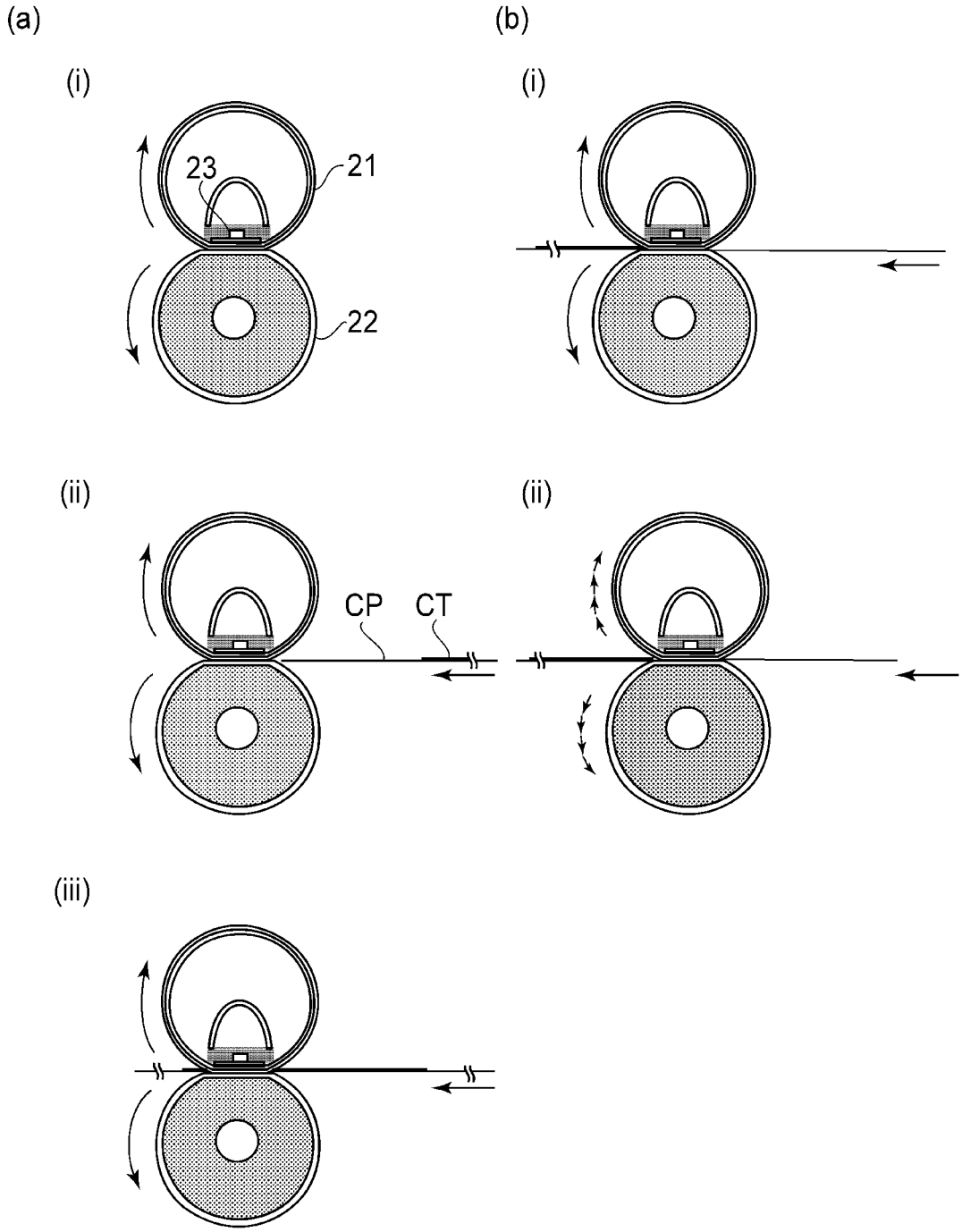

Parts (a) and (b) of FIG. 4 are schematic views for illustrating a cleaning mode, wherein (a) includes illustrations of a first cleaning operation and (b) includes illustrations of a second cleaning operation.

DESCRIPTION OF THE PREFERRED EMBODIMENTS

Embodiment 1

(1) Image Forming Apparatus

Figure 1:
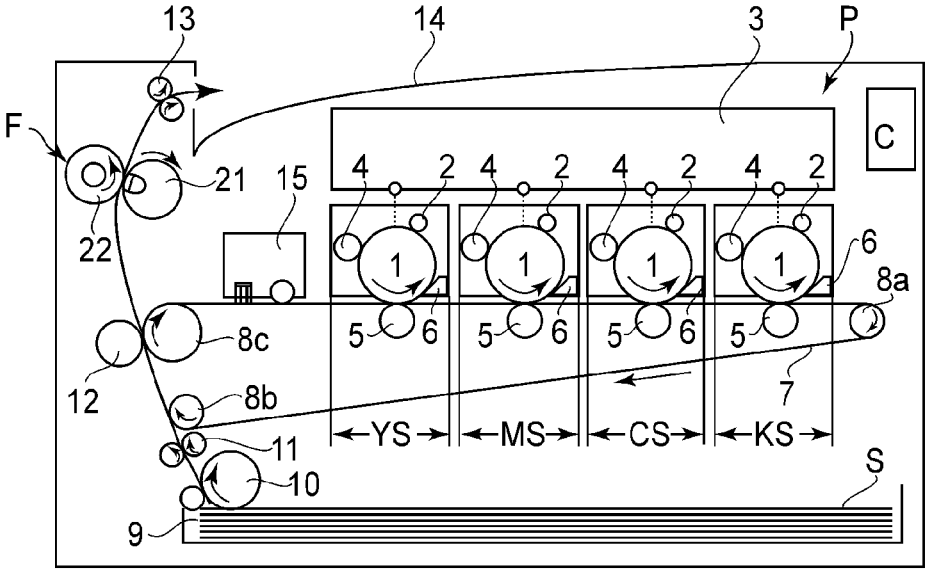
Figure 1:
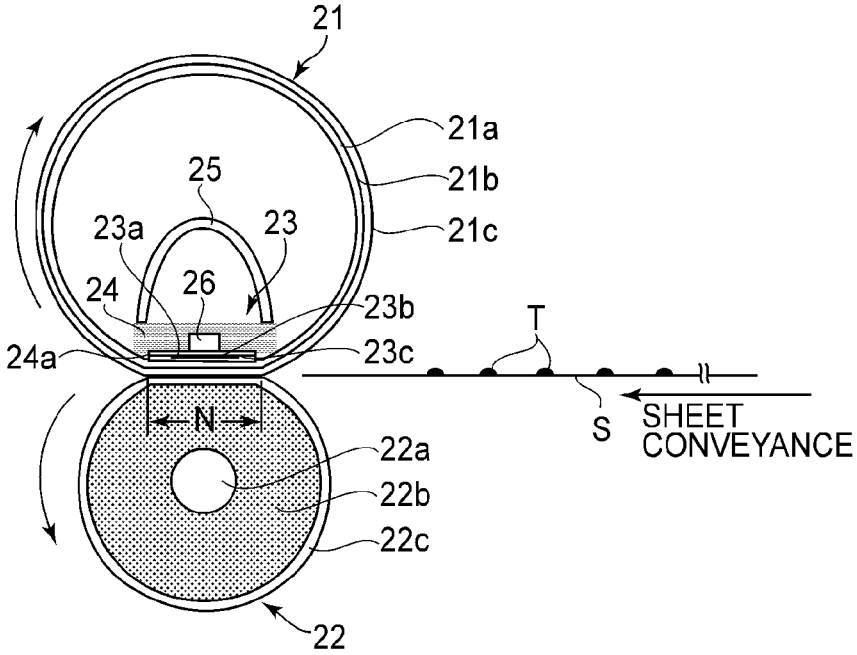

FIG. 1 is a schematic structural view of an example of an image forming apparatus according to this embodiment of the present invention. This image forming apparatus is a full-color laser (beam) printer for forming an image on a recording material such as transfer paper or an OHP sheet by utilizing electrophotography.

The image forming apparatus in this embodiment includes roughly classified three portions consisting of an image forming portion P for forming an unfixed toner image on a recording material S, a fixing portion for heat-fixing the unfixed toner image on the recording material S (hereinafter referred to as a fixing device), and a control portion (controller) C for controlling the image forming portion P, the fixing device F and the like. The image forming portion P includes four image forming stations YS, MS, CS and KS. Of the four image forming stations, the image forming station YS forms an image of yellow (Y) and the image forming station MS forms an image of magenta (M). Further, the image forming station CS forms an image of cyan (C) and the image forming station KS forms an image of black (K). Each of the image forming stations YS, MS, CS and KS includes a drum-type electrophotographic photosensitive member 1 as an image bearing member (hereinafter referred to as a photosensitive drum) and a charging roller 2 as a charging means. Further, each of the image forming apparatus YS, MS, CS and KS includes an exposure device 3 as an exposure means, a developing device 4 as a developing means, a primary transfer roller 5 as a primary transfer member, a drum cleaner 6 as a cleaning means, and the like. The controller C includes a CPU and memories such as ROM and RAM. In the memories, information on an image formation control sequence and a cleaning mode and various tables and programs which are necessary for the image formation control sequence and the cleaning mode are stored. The controller C executes the image formation control sequence depending on a print instruction (job) outputted from an external device (not shown) such as a host computer and controls the image forming portion P and the fixing device F in accordance with the image formation control sequence.

In the image forming apparatus in this embodiment, when the image formation control sequence is executed, the photosensitive drum 1 is rotated in an arrow direction at the image forming station YS. First, a peripheral surface of the photosensitive drum 1 is uniformly charged to a predetermined potential and a predetermined polarity by the charging roller 2 (charging step). Then, the charged surface of the photosensitive drum 1 is irradiated with laser light, by the exposure device 3, depending on image information (image data) inputted from the external device, so that the charged surface of the photosensitive drum 1 is exposed to light and thus an electrostatic latent image (electrostatic image) is formed on the surface of the photosensitive drum 1 (exposure step). This latent image is visualized into Y toner image with Y toner by the developing device 4. As a result, the Y toner image is formed on the surface of the photosensitive drum 1 (developing step). Also at the image forming stations Ms, Cs and KS, a similar image forming process including the charging step, the exposure step and the developing step is performed. As a result, an M toner image, a contact toner image and a K toner image are formed on the photosensitive drums 1 at the image forming stations MS, CS and KS, respectively. An endless intermediary transfer belt 7 as a toner image conveying member provided along an arrangement direction of the image forming stations YS, MS, CS and KS is stretched around a driving roller 8*a*, a follower roller 8*b* and a secondary transfer opposite roller 8*c*. The intermediary transfer belt 7 is rotated in an arrow direction along the image forming stations YS, MS, CS and KS at a peripheral speed of 120 mm/sec by the driving roller 8. Onto the peripheral surface of the intermediary transfer belt 7, the color toner images are successively transferred superposedly by primary transfer rollers 5 provided to oppose the photosensitive drums 1 while sandwiching the intermediary transfer belt 7 (primary transfer step). As a result, unfixed toner images for a four-color based full-color image are carried on the surface of the intermediary transfer belt 7. After the primary transfer, untransferred toner remaining on the surface of each of the photosensitive drums 1 is removed by an associated drum cleaner 6 and then each photosensitive drum 1 is subjected to subsequent image formation.

On the other hand, the recording material (recording paper) S stacked and accommodated in a feeding cassette 9 provided below the intermediary transfer belt 7 is separated and fed one by one from the feeding cassette 9 by a feeding roller 10 and then is fed to a registration roller pair 11. The registration roller pair 11 sends the fed recording material S into a secondary transfer nip between the intermediary transfer belt 7 and a secondary transfer roller 12 provided to oppose the secondary transfer opposite roller 8*c* while sandwiching the intermediary transfer belt 7. The recording material S is nip-conveyed in the secondary transfer nip by the surface of the intermediary transfer belt 7 and the peripheral surface of the secondary transfer roller 12. In this conveyance process, the unfixed toner images on the intermediary transfer belt 7 surface are transferred onto the recording material S by the secondary transfer roller 12 and are kept in that state (secondary transfer step). The recording material S which carries the unfixed toner images is introduced into a fixing nip N, which will be described later, of the fixing device F. The recording material S is passed through the fixing nip N, so that the unfixed toner images is subjected to heat and pressure to be heated-fixed on the surface of the recording material S. The recording material S is conveyed from the fixing device F to discharging rollers 13 and is discharged on a discharge tray 14 by the discharging rollers 13. Untransferred toner remaining on the intermediary transfer belt 7 after the secondary transfer is removed by a belt cleaner 15 as an image conveying member cleaning means. Then, the intermediary transfer belt 7 is subjected to subsequent image formation.

(2) Fixing Device (Fixing Portion)

Part (b) of FIG. 1 is a schematic structural view of an example of the fixing device F in this embodiment. The fixing device F is of a film heating type. With respect to the fixing device F and constituent elements constituting the fixing device F, a longitudinal direction is a direction perpendicular to a recording material (sheet) conveyance direction in a plane of the recording material S. A widthwise direction is a direction parallel to the recording material conveyance direction in the plane of the recording material S. A width is a dimension with respect to the widthwise direction. With respect to the recording material S, a longitudinal direction is a direction parallel to the recording material conveyance direction in the plane of the recording material S. A widthwise direction is a direction perpendicular to the recording material conveyance direction in the plane of the recording material S. A length is a dimension with respect to the longitudinal direction.

The fixing device F in this embodiment includes a fixing film (endless belt) 21 as a first rotatable member, a pressing roller 22 as a second rotatable member, a ceramic heater 23 as a heating member, and the like. An outer diameter of the fixing film 21 formed by molding a flexible film sheet in a cylindrical shape is about 18 mm. The fixing film 21 includes a cylindrical polyimide base layer 21*a* which has flexibility and heat resistance and has the outer diameter of 18 mm. On an outer peripheral surface of the polyimide base layer 21*a*, an about 200 μm-thick elastic layer 22*b* of a silicone rubber is provided and thereon, a 15 μm-thick parting layer 22*c* of PFA is provided.

Inside the fixing film 21, a heater 23, a heater holder 24 for supporting the member 23, and a pressing stay 25 for supporting the heater holder 24 and for pressing the inner peripheral surface of the fixing film 21 are disposed. The heater 23 includes an elongated heat-resistant member substrate 23*a* formed of a material such as aluminum nitride or alumina. On the surface (toward the fixing nip N) of the heater substrate 23*a*, a resistor pattern 23*b* as a heat generating resistance layer which generates heat by energization is formed along a longitudinal direction of the heater substrate 23*a* by printing. The resistor pattern 23*b* is coated with a glass layer 23*c* as a protective layer provided on the surface of the heater substrate 23*a*. On a back surface (opposite from the fixing nip N) of the member substrate 23*a*, a thermistor 26 as a temperature detecting member is provided at a position corresponding to a longitudinal central portion of the resistor pattern 23*b* on the surface of the heater substrate 23*a*. At a widthwise central position of a lower surface (toward the fixing nip N) of the heater holder 24 formed of heat-resistant resin, a groove 24*a* is provided along the longitudinal direction of the heater holder 24. In the groove 24*a* of the heater holder 24, the heater substrate 23*a* of the heater 23 is fixed and supported in a state in which the glass layer 23*c* is exposed from an opening of the groove 24*a*. The heater holder 24 is supported vertically movably by a device frame (not shown) of the fixing device F at longitudinal and portions thereof. The pressing stay 25 formed of metal provided on an upper surface (opposite from the fixing nip N) of the heater holder 24 is supported vertically movably by the device frame at longitudinal end portions thereof.

The pressing roller 22 formed in a cylindrical shaft shape has an outer diameter of about 20 mm. The pressing roller 22 includes a core metal 22*a* formed of stainless steel in an outer diameter of 13 mm. On the outer peripheral surface of the core metal 22*a*, an about 3.5 mm-thick elastic layer 22*b* formed of a silicone rubber is provided and thereon, an about 30 μm-thick parting layer of PFA is provided. The pressing roller 22 is disposed under the fixing film 21 so that the surface thereof opposes the surface of the fixing film 21. The pressing roller 22 is rotatably supported by the device frame at longitudinal end portions thereof through bearings (not shown). The bearings for the pressing roller 22 are urged in a radial direction of the fixing film 21 by urging springs (not shown) with a predetermined urging force. Further, the pressing stay 25 is urged at its longitudinal end portions in the radial direction of the pressing roller 22 by urging springs (not shown) with an urging force of 196N (20 kgf). By the urging forces of these urging springs, the surface of the pressing roller 22 urged toward the heater substrate 23*a* of the heater 23 via the fixing film 21. As a result, the elastic layer 22*b* of the pressing roller 22 is elastically deformed along the longitudinal direction of the heater 23 to form the fixing nip N with a predetermined width (7 mm) between the surface of the fixing film 21 and the surface of the pressing roller 22.

(2-1) Heat-Fixing Operation of Fixing Device

Depending on a print instruction, the pressing roller 22 is rotated in an arrow direction at a predetermined peripheral speed (process speed). The rotation of the pressing roller 22 is transmitted to the surface of the fixing film 21 by a frictional force between the surface of the pressing roller 22 and the surface of the fixing film 21 in the fixing nip N. As a result, the fixing film 21 is rotated in an arrow direction at a predetermined peripheral speed (process speed) by the rotation of the pressing roller 22 while sliding on the surface of the glass layer 23*c* of the heater 23 at the inner surface thereof. Further, depending on the print instruction, a triac (not shown) as an energization control circuit is turned on, so that energy is supplied to the resistor pattern 23*b* of the heater 23. As a result, the resistor pattern 23*b* generates heat, so that the heater 23 is quickly increased in temperature to heat the fixing film 21. The temperature of the heater 23 is detected by the thermistor 26. On the basis of an output signal from the thermistor 26 (hereinafter referred to as a thermistor detection temperature), the triac is subjected to ON/OFF control so that the temperature of the heater 23 is kept at a predetermined temperature-control temperature (target temperature). In this embodiment, the temperature-control temperature is set at 170° C. When the pressing roller 22 is rotated and the temperature of the heater 23 is kept at the temperature-control temperature, the recording material S carrying thereon the unfixed toner images is introduced into the fixing nip N. The recording material S is nipped and conveyed in the nipped state by the fixing film 21 and the pressing roller 22 in the fixing nip N. In this conveyance process, the unfixed toner images T are heat-fixed on the recording material S by being subjected to heat of the fixing film 21 and pressure of the pressing roller 22. Then, the recording material S on which the unfixed toner images T are heat-fixed is separated from the surface of the fixing film 21 and is discharged from the fixing nip N.

The image forming apparatus in this embodiment is capable of setting a cleaning mode in which the fixing portion is cleaned while nip-conveying a cleaning sheet in the fixing nip N. When the cleaning mode is set, the image forming apparatus executes a plurality of types of cleaning operations in a period in which a single cleaning sheet passes through the fixing nip.

Further, as will be described later in Embodiment 2, when the cleaning mode is set, the image forming apparatus provides a period in which the first rotatable member and the second rotatable member are rotated in a state in which the heater is controlled so that a surface temperature Tp of the second rotatable member immediately after passing through the fixing nip is within a temperature range $Tf2 \leqq Tp \leqq Tf3$ wherein Tf2 is a deformation end point of the toner and Tf3 is a flow start point of the toner. After a lapse of the period, the cleaning sheet is conveyed in the fixing nip and a first cleaning operation described later may preferably be performed.

First, the flow start point, the deformation end point and the like of the toner will be described.

(2-2) Thermodynamic Properties of Toner

In this embodiment, toner A constituted by a binder resin of polyester and a crystalline max of paraffin was used. The toner A has thermodynamic properties including a deformation start point (Tf1), a deformation end point (Tf2), a flow start point (Tf3), a flow end point (Tf4) and a softening point (Ts). The toner A has the deformation start point (Tf1) of about 42° C., the deformation end point (Tf2) of about 60° C., the flow start point (Tf3) of about 93° C., the flow end point (Tf4) of about 141° C. and the softening point (Ts) of about 117° C.

The deformation start point (Tf1) and the deformation end point (Tf2) of the toner A will be described. The deformation start point (Tf1) of the toner A is a temperature at which the toner starts its deformation when the toner is placed in a hermetically sealed container and then the temperature of the toner is gradually increased while applying certain pressure to the toner. Then, the toner is continuously deformed by further increasing the temperature of the toner A but the deformation of the toner is stopped at a certain temperature. Even when the temperature of the toner is further increased, the toner is not substantially deformed. The temperature at which the deformation of the toner A is stopped is the deformation end point (Tf2) of the toner A. Specifically, measurement is performed in the following manner. First, when a true density of the toner A is $\rho$(g/cm$^3$), (0.16×$\rho$) g of the toner A is weighed and placed in a pressure molding machine and is subjected to pressure molding for 2 minutes under a load of 1960 N (200 kgf) in a normal temperature and normal humidity environment to prepare a columnar sample of about 8 mm in diameter and about 2 mm in height. Then, at a central portion of a polished bottom of a cylindrical container of about 10 mm in inner diameter and 200 mm or more in inner wall height, the columnar sample is placed. Further, a pressing jig of about 9.9 mm in outer diameter and 10 mm in thickness is contacted to the sample. In this state, the sample is held at 35° C. for 5 minutes. Thereafter, a load of 98 N (10 kgf) is applied to the pressing jig and the columnar sample is increased in temperature up to 120° C. at a temperature rise rate of 1° C./min., and then an amount of displacement of the pressing jig contacted to the sample is measured. At that time, a temperature at which the pressing jig starts its displacement is the deformation start point (Tf1) of the toner A. Further, a temperature at which an increase in amount of displacement of the pressing jig which has started its displacement is stopped is the deformation end point (Tf2).

In this embodiment, the above measurement was performed by a flow tester ("CFT-100D", mfd. by Shimadzu Corp.). An example of the measurement result is shown in (a) of FIG. 2. In the graph, an ordinate represents the amount of displacement (stroke) of the pressing jig and an abscissa represents the temperature of the toner A. As shown in (a) of FIG. 2, from the deformation start point (Tf1) to the deformation end point (Tf2) of the toner A, the amount of displacement of the toner A is abruptly increased. This is because rigidity of the toner A is abruptly lowered between the deformation start point (Tf1) and the deformation end point (Tf2). This is attributable to an occurrence of glass transition of an amorphous component of the toner A. A temperature at which the amorphous component of the toner A starts the glass transition is in the neighborhood of the deformation start point (Tf1). A temperature at which the glass transition of the amorphous component of the toner A is substantially entirely ended is in the neighborhood of the deformation end point (Tf2). When the temperature of the toner A is not less than the deformation end point (Tf2), the glass transition of the amorphous component is ended and therefore the rigidity of the toner A is not lowered, so that the amount of displacement of the pressing jig is also not increased.

The flow start point (Tf3) and the flow end point (Tf4) of the toner A will be described. The flow start point (Tf3) of the toner A is a temperature at which the toner starts its flowing out through a hole when the toner is placed in a hermetically sealed container except that a bottom of the container is provided with the hole, and then the temperature of the toner is gradually increased while applying certain pressure to the toner. Then, the toner is continuously flows out by further increasing the temperature of the toner A but the toner completely flows out at a certain temperature. The temperature at which the toner A completely flows out in the flow end point (Tf4) of the toner A. Specifically, measurement is performed in the following manner. First, (0.96×$\rho$) g of the toner A is weighed and placed in a pressure molding machine and is subjected to pressure molding for 2 minutes under a load of 1960 N (200 kgf) in a normal temperature and normal humidity environment to prepare a columnar sample of about 10 mm in diameter and about 12 mm in height. Then, at a central portion of a polished bottom, provided with a cylindrical hole of 1 mm in diameter and 0.5 mm in thickness, of a cylindrical container of about 10 mm in inner diameter and 200 mm or more in inner wall height, the columnar sample is placed. Further, a pressing jig of about 9.9 mm in outer diameter and 10 mm in thickness is contacted to the sample. In this state, the sample is held at 35 40 C for 5 minutes. Thereafter, a load of 98 N (10 kgf) is applied to the pressing jig and the columnar sample is increased in temperature up to 200° C. at a temperature rise rate of 4° C./min., and then an amount of displacement of the pressing jig contacted to the sample is measured. At that time, a temperature at which to toner A flows out through the hole provided at the bottom of the cylindrical container and the pressing jig starts its displacement is the flow start point (Tf3) of the toner A. Further, a temperature at which the pressing jig does not cause its displacement by completion of the entire flowing out of the toner from the cylindrical container is the flow end point (Tf4).

In this embodiment, the above measurement was performed by the flow tester ("CFT-100D", mfd. by Shimadzu Corp.). An example of the measurement result is shown in (b) of FIG. 2. In the graph, an ordinate represents the amount of displacement (stroke) of the pressing jig and an abscissa represents the temperature of the toner A. As shown in (b) of FIG. 2, from the flow start point (Tf3) to the flow end point (Tf4) of the toner A, the amount of displacement of the toner A is abruptly increased. This is because flowability of the toner A is abruptly increased from the flow start point (Tf3). This is attributable to an occurrence of fusion of a crystalline component of the toner A. A temperature at which the crystalline component of the toner A starts the fusion is in the neighborhood of the flow start point (Tf3) of the toner. A temperature at which the fusion of the crystalline component of the toner A is ended is in the neighborhood of the flow end point (Tf4) of the toner. The softening point (Ts) of the toner A is a just middle temperature between the flow start point (Tf3) of the toner A and the flow end point (Tf4) of the toner A. In this state, the crystalline component of the toner A is fused (melted) to some extent and has the flowability. For this reason, when the temperature of the toner A is not less than the softening point (Ts), the toner A has a large adhesive force to the recording material S.

Figure 2:
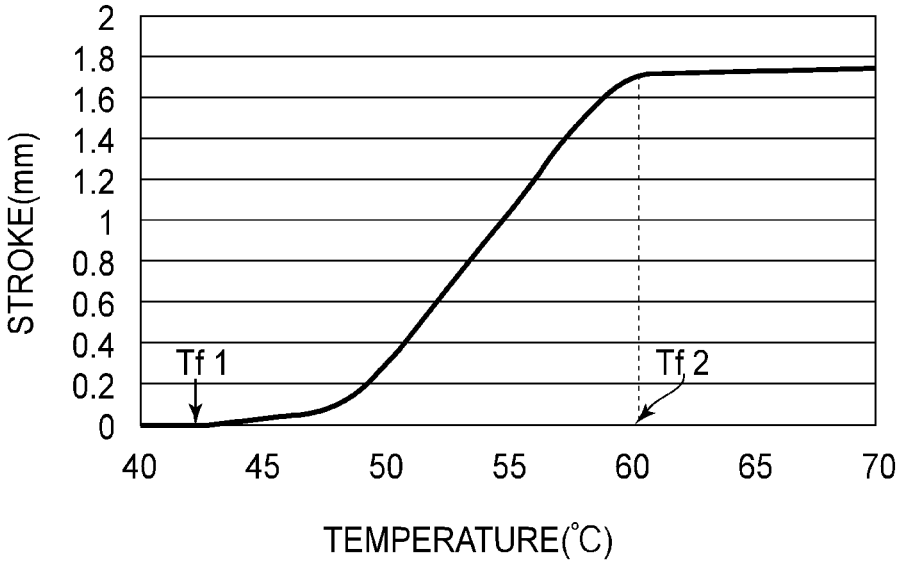
Figure 2:
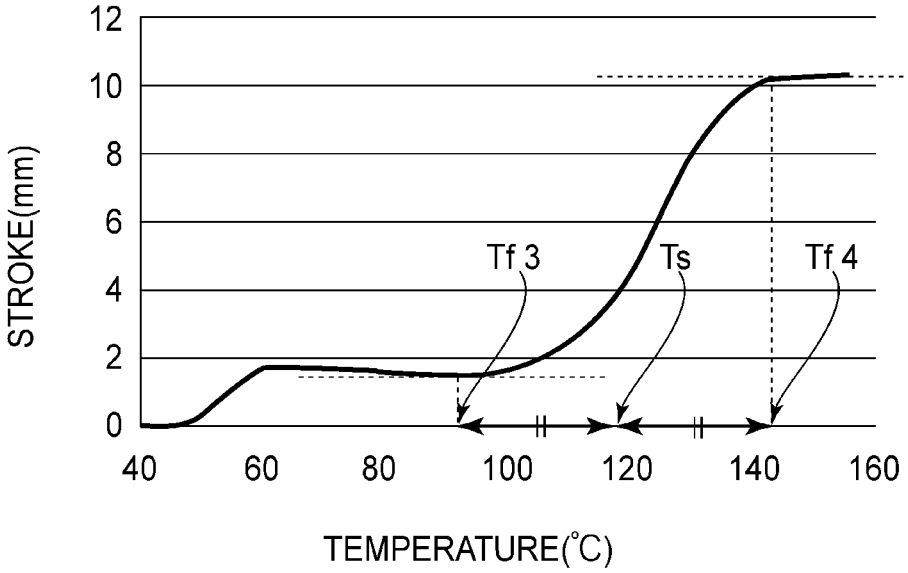

As is understood from the above description with reference to (a) and (b) of FIG. 2, with respect to the toner, among the deformation start point (Tf1), the deformation end point (Tf2), the flow start point (Tf3), the flow end point (Tf4) and the softening point (Ts), the following relationship is satisfied.

$$Tf1<Tf2<Tf3<Ts<Tf4$$

(2-3) Cleaning Mode

The cleaning mode is executed when a user provides an instruction to effect cleaning from, e.g., a personal computer or when the user selects the cleaning mode by an operation of a switch provided to the image forming apparatus.

FIG. 3 shows an example of the recording material on which an unfixed solid toner image is carried as a cleaning pattern (cleaning sheet) CT. In order to differentiate the recording material from the recording material S used in the normal image formation, the recording material carrying thereon the unfixed solid toner image is referred to as cleaning paper CP.

Part (a) of FIG. 3 is a schematic view showing a cleaning area 1 provided on a surface of the cleaning paper CP to be contacted to the surface of the fixing film 21, and (b) of FIG. 3 is a schematic view showing a cleaning area 2 provided on a surface of the cleaning paper CP to be contacted to the surface of the pressing roller 22. In this embodiment, as the cleaning pattern CT, the unfixed solid toner image using black toner (herein referred to as the solid image) is carried on the surface of the cleaning paper (recording material) to be contacted to the surface of the fixing film 21 as shown (a) of FIG. 3.

The solid image CT is carried on the cleaning paper CP substantially over an entire area at a part of the surface of the cleaning paper CP with respect to a widthwise direction perpendicular to the recording material (sheet) conveyance direction. A length L2 of the solid image CT in the recording material conveyance direction is set at 60 mm which is longer than one full circumference of the surface of the fixing film 21 so that the first cleaning operation described later can be performed over an area which is not less than the one full circumference of the surface of the fixing film 21. Hereinafter, a solid image forming area of the cleaning paper CP is referred to as the cleaning area 1 (cleaning pattern formation area).

Further, with respect to the recording material conveyance direction, a length L3 of an area, ranging from a rear end of the solid image CT to a trailing end of the cleaning paper CP, in which the solid image CT is not carried, i.e., a solid white area is set at 80 mm which is longer than one full circumference of the surface of the pressing roller 22. This is because the second cleaning operation described later can be performed over an area which is not less than the one full circumference of the surface of the pressing roller 22. Hereinafter, a solid white area from the rear end of the solid image CT of the cleaning paper CP to the trailing end of the cleaning paper CP is referred to as the cleaning area 2 (cleaning pattern non-formation area).

Further, with respect to the recording material conveyance direction, a length L1 of an area, ranging from a leading end of the cleaning paper CP to a front end of the solid image CT, in which the solid image CT is not carried, i.e., a marginal portion is set at 135 mm. That is, the marginal portion in the length which is longer than a distance of 130 mm from the fixing nip N to the discharge roller 13 is provided on the leading end side of the cleaning paper CP. This is because inconvenience such as jam such that the cleaning paper CP is wound about the surface of the fixing film 21 occurring when the solid image CT is present at the leading end side of the cleaning paper CP can be prevented. As the recording material for the cleaning paper CP, an A4-sized cleaning sheet (trade name: "TAEHA", basis weight: 75 $g/m_2$) was used. In the cleaning mode, the unfixed toner image CT for cleaning is formed in the following manner. When the cleaning mode is executed, an image pattern for cleaning stored in ROM is developed. Then, by the same operation as the above-described image forming operation (normal image forming operation), the unfixed toner image for cleaning is formed on the cleaning sheet to prepare cleaning paper. That is, by using the image forming station KS, the following steps are performed in synchronism with the rotation of the intermediary transfer belt. That is, the charging step using the charging roller, the exposure step using the exposure device, the developing step using the developing device and the primary transfer step using the primary transfer roller are performed in synchronism with the rotation of the intermediary transfer belt. As a result, on the surface of the intermediary transfer belt, the solid image using the black toner at the image forming station KS is carried. On the other hand, the recording material is fed from the feeding cassette by the feeding roller. The recording material is further conveyed to the secondary transfer nip with predetermined timing by the registration rollers. Then, by the secondary transfer roller, the solid image on the surface of the intermediary transfer belt is transferred and carried on the recording material by the secondary transfer roller. The cleaning pattern CT may only be required to remove the toner contaminant on the surface if the fixing film 21. Other factors such as the form of the cleaning pattern, arrangement of the cleaning pattern, an amount per unit of the toner and selection of the color of the toner are not limited to those in this embodiment.

In the cleaning mode in this embodiment, the following first cleaning operation and second cleaning operation are performed. Before the first cleaning operation is performed, the image forming apparatus is left standing until a thermistor detection temperature becomes a normal temperature (30° C. or less), so that the surface temperature (peripheral surface temperature) of the pressing roller 22 is cooled to the normal temperature.

First, as the first cleaning operation, a temperature-control temperature of the heater 23 is set at 150° C. (predetermined temperature) used during pre-rotation of normal image formation, and then the fixing film 21 is idled (rotated) for a predetermined time at a rotational speed of 50 mm/sec ((i) of (a) of FIG. 4). In this embodiment, the fixing film 21 is idled for 60 seconds. The pre-rotation is a preparatory operation for the image formation to be executed when a print instruction is inputted. The pre-rotation is performed for rotating the photosensitive drum 1 and for causing predetermined process equipment to perform a predetermined preparatory operation for the image formation. That is, the first cleaning operation includes an operation in which the fixing film 21 is heated to a predetermined temperature and is rotated before the cleaning paper CP passes through the fixing nip N. Then, while the rotational speed of the fixing film 21 is kept at 50 mm/sec, the temperature-control temperature is changed to 170° C. (predetermined temperature). Then, the cleaning paper CP is introduced into the fixing nip N until the cleaning area 1 of the cleaning paper CP reaches the fixing nip N ((ii) and (iii) of (a) of FIG. 4). The first cleaning operation is performed for executing the cleaning operation in the cleaning area 1.

Next, as the second cleaning operation, the temperature-control temperature of the heater 23 is changed to 200° C. with timing when the front end of the cleaning area 2 of the cleaning paper CP enters the fixing nip N. The surface temperature (peripheral surface temperature) when the temperature-control temperature of the heater 23 is changed to 200° C. is higher than the normal surface temperature of the pressing roller 22. After the temperature-control temperature of the heater 23 is changed to 200° C., the rotation of the pressing roller 22 and the fixing film 21 and energization to the heater 23 are stopped ((i) of (b) of FIG. 4). Thereafter, in the case where the surface temperature of the fixing film 21 is judged as being lower than 190° C., the cleaning paper CP is conveyed (fed) again by a length of 7 mm which is equal to the nip width of the fixing nip N. An operation of one cycle including the above operations (hereinafter referred to as a step feeding) is repeated until the trailing end of the cleaning paper CP enters the fixing nip N. That is, in the second cleaning operation, the cleaning paper CP is nipped in the fixing nip N and then one step of control including heating of the fixing nip, cooling of the fixing nip and feeding of the cleaning paper to a subsequent cleaning position is repeated plural times ((ii) of (b) of FIG. 4). The second cleaning operation is performed for executing the cleaning operation in the cleaning area 2.

That is, in this embodiment, when the cleaning mode is set, in a period in which one cleaning paper passes through the fixing nip, two (plural) types of the cleaning operations are performed. These cleaning operations include the first cleaning operation for removing the contaminant, which is principally constituted by the toner of at least the unfixed toner image, on the fixing film surface and the second cleaning operation for removing the contaminant, which is principally constituted by the paper powder and the filler of the recording material, on the pressing roller surface. Particularly, in this embodiment, when the cleaning mode is set, the image forming apparatus prepares the cleaning sheet for carrying the unfixed toner image for cleaning by using the image forming portion and then executes the first cleaning operation in which the cleaning sheet is conveyed while heating the unfixed toner image for cleaning in the fixing nip and the second cleaning operation, performed in a state in which the area of the cleaning sheet on which the unfixed toner image for cleaning is not carried is nipped in the fixing nip, in which the operation for heating and cooling the fixing nip in a state in which the conveyance of the cleaning sheet is stopped is repeated while gradually feeding the cleaning sheet.

(2-4) Effect of Cleaning Mode

A checking method of effects of the cleaning mode will be described. First, by using the image forming apparatus and the fixing device F, in a low temperature and low humidity environment (15° C., 10% RH), 1000 sheets of the recording material were passed through the fixing device F at the recording material conveyance speed of 50 mm/sec and at the temperature-control temperature of 170° C. Thereafter, the cleaning mode in this embodiment is executed and then the contaminant on the surface of the fixing film 21 and the surface of the pressing roller 22 after the execution of the cleaning operations. As the recording material, the A4-sized cleaning sheet (trade name: "TAEHA", basis weight: 75 $g/m_2$) was used. The reason why "TAEHA" is used as the recording material is that "TAEHA" contains a large amount of a filler such as calcium carbonate or talc which is liable to result in the contaminant on the surface of the pressing roller 22 and thus the parting property of the surface of the fixing film 21 is liable to be lowered and the toner contaminant due to offset is liable to occur. Further, also with respect to the cleaning paper CP, "TAEHA" was similarly used, but the cleaning paper CP is not limited thereto. A desired recording material may also be used as the cleaning paper CP.

Next, image forming apparatuses in Comparative Embodiments 1 to 3 for comparison of the effect in this embodiment will be described.

Comparative Embodiment 1

With respect to the image forming apparatus in Comparative Embodiment 1, 1000 sheets of the recording material ("TAEHA") were passed through the fixing device and then the contaminant on the fixing film surface and the pressing roller surface was checked after the execution of the cleaning operation without execution of the cleaning mode. Except for this point, the image forming apparatus in Comparative Embodiment 1 has the same constitution as that in Embodiment 1.

Comparative Embodiment 1

With respect to the image forming apparatus in Comparative Embodiment 2, only the first cleaning operation, in the cleaning mode of the image forming apparatus in Embodiment 1, including the idling of the fixing film for 60 seconds was performed from the leading end to the trailing end of the cleaning paper. After the execution of the first cleaning operation, the contaminant on the fixing film surface and the pressing roller surface was checked. Except for this point, the image forming apparatus in Comparative Embodiment 2 has the same constitution as that in Embodiment 1.

Comparative Embodiment 3

With respect to the image forming apparatus in Comparative Embodiment 3, only the second cleaning operation (step feeding) including no idling of the fixing film for 60 seconds was performed from the leading end to the trailing end of the cleaning paper. After the execution of the second cleaning operation, the contaminant on the fixing film surface and the pressing roller surface was checked. Except for this point, the image forming apparatus in Comparative Embodiment 3 has the same constitution as that in Embodiment 1.

(Evaluation Result)

In Comparative Embodiment 1, a toner rich toner contaminant, i.e., a contaminant with a toner ratio larger than a paper powder ratio was partly deposited on the surface of the fixing film 21, and a toner contaminant containing the paper powder was deposited in a large amount on the surface of the pressing roller 22. In Comparative Embodiment 2, the toner contaminant on the surface of the fixing film 21 was completely removed by the cleaning paper but a paper powder rich toner contaminant, i.e., a toner contaminant with the paper powder ratio larger than the toner ratio on the surface of the pressing roller 22 was little removed. In Comparative Embodiment 3, the toner rich toner contaminant was partly deposited on the surface of the fixing film 21 although the amount thereof was smaller than that in Comparative Embodiment 1. Further, on the surface of the pressing roller 22, the paper powder rich toner contaminant was deposited without being removed although the amount thereof was smaller than that in Comparative Embodiment 1.

On the other hand, in this embodiment, on both of the surface of the fixing film 21 and the surface of the pressing roller 22, the toner contaminant was little observed and 95% or more of the toner contaminant was removed. Further, with respect to 5% or less of the remaining toner contaminant, the toner contaminant was not deposited on the recording material during the normal image forming operation, so that it was possible to obtain an excellent cleaning effect.

(Action of First Cleaning Operation)

An object of the first cleaning operation is to discharge the toner rich toner contaminant deposited on the fixing film surface to the outside of the fixing device F by melting the toner rich toner contaminant together with the solid image formed on the cleaning paper and by fixing the toner rich toner contaminant on the cleaning paper. In this first cleaning operation, the toner contaminant on the fixing film surface is transferred onto the cleaning paper to some extent even when the solid image is not carried on the cleaning paper. However, as in this embodiment, when the solid image is carried on the cleaning paper, the paper powder rich contaminant on the fixing film surface is smoothly transferred onto the cleaning paper by an adhesive force generated during melting of the unfixed toner image. In this embodiment, the solid image is carried as the cleaning pattern on the cleaning paper but the cleaning pattern is not limited thereto. A desired pattern may also be used as the cleaning pattern.

(Action of Second Cleaning Operation)

An object of the second cleaning operation is to successively transfer the toner contaminant from the pressing roller surface onto the cleaning paper by nipping the area of the cleaning paper on which the solid image is not formed and then by feeding the cleaning paper while repeating the rotation of the pressing roller and the fixing film and the stop of the rotation plural times. During the stop of the rotation of the pressing roller, the surface temperature of the pressing roller is made not less than the softening point of the toner, so that the toner contained in the toner contaminant deposited on the pressing roller surface is melted. As a result, the adhesive force between the toner contaminant and the cleaning paper and a permeating property of the toner contaminant into the cleaning paper are increased, so that the toner contaminant on the pressing roller surface can be easily discharged on the cleaning paper and thus can be removed efficiently.

(Operation Order of First Cleaning Operation and Second Cleaning Operation)

The order of execution of the first cleaning operation and the second cleaning operation in the cleaning mode in this embodiment will be described. The order of the cleaning operations in this embodiment is intended to be determined so as to prevent the solid image formed on the cleaning paper from being hot-offset to further contaminate the cleaning paper or the fixing film surface. The fixing device used in this embodiment has the constitution in which the heater is incorporated inside the fixing film and therefore the surface temperature of the pressing roller which is remote from the heater as a heating source than the fixing film is inevitably lower than the surface temperature of the fixing film. That is, the temperature-control temperature during the second cleaning operation for removing the toner contaminant on the pressing roller surface is set at a value which is higher than that of the temperature-control temperature during the first cleaning operation for removing the toner contaminant on the fixing film surface. As a result, the toner contaminant deposited on the pressing roller surface is melted and thus there is a need to obtain a removing effect of the toner contaminant deposited on the pressing roller surface.

On the other hand, the temperature-control temperature during passing of the cleaning paper through the fixing nip in the first cleaning operation for removing the toner contaminant on the fixing film surface is required to be set in a range in which the solid image on the cleaning paper is not offset. Assuming that the second cleaning operation is performed and then the first cleaning operation is performed, the surface temperature of the fixing film immediately after the second cleaning operation is performed (immediately before the first cleaning operation is performed) is increased up to a temperature at which the toner contaminant on the pressing roller surface is satisfactorily melted. For that reason, there is a high possibility that the solid image formed on the cleaning paper is hot-offset. Therefore, it is preferable that the second cleaning operation is performed after the first cleaning.

As described above, the image forming apparatus in this embodiment is capable of removing the contaminant deposited on the surface of the fixing film 21 and the contaminant deposited on the surface of the pressing roller 22 at the same time by passing the cleaning paper through the fixing nip one time in the cleaning mode. As a result, it is possible to simultaneously remove the contaminants on the surfaces of the fixing film 21 and the pressing roller 22 without impairing usability.

Embodiment 2

Another example of the image forming apparatus will be described. In this embodiment, constituent elements or portions of the image forming apparatus identical to those in Embodiment 1 are represented by the same reference numerals or symbols and will be omitted from redundant description. An object of the image forming apparatus in this embodiment is to improve a cleaning performance particularly with respect to the paper powder rich toner contaminant deposited on the surface of the pressing roller 22 of the surfaces of the fixing film 21 and the pressing roller 22.

In the image forming apparatus in this embodiment, in the first cleaning operation, a relationship among a surface temperature Tp of the pressing roller, a deformation end point (temperature) Tf2 of the toner and a flow start point (temperature) Tf3 of the toner during the idling of the fixing film is set to satisfy: Tf2≦Tp≦Tf3. Except for this point, the image forming apparatus in this embodiment has the same constitution as that of the image forming apparatus in Embodiment 1.

In this embodiment, the temperature-control temperature of the heater 23 during the idling in the first cleaning operation was set at 100° C. and at that time, the surface temperature Tp of the pressing roller 22 was 78° C. In Embodiment 1, the temperature-control temperature of the heater 23 during the idling in the first cleaning operation was set at 150° C. and at that time, the surface temperature Tp of the pressing roller 22 was 131° C.

An image forming apparatus in Comparative Embodiment 4 for comparison of the effect in this embodiment will be described.

Comparative Embodiment 4

The image forming apparatus in Comparative Embodiment 4 has the same constitution as that of the image forming apparatus in Comparative Embodiment 2 for comparison with Embodiment 1. That is, in the cleaning mode of the image forming apparatus in Comparative Embodiment 4, only the first cleaning operation including the idling of the fixing film for 60 seconds was performed from the leading end to the trailing end of the cleaning paper. After the first cleaning operation was performed, the contaminant on the fixing film surface and the pressing roller surface was checked. Except for this point, the image forming apparatus in Comparative Embodiment 4 has the same constitution as that of the image forming apparatus in Embodiment 2.

(Evaluation Result)

In Comparative Embodiment 4, compared with Comparative Embodiment 2, the paper powder rich toner contaminant on the surface of the pressing roller 22 was removed but was not sufficient. Further, the toner contaminant on the surface of the fixing film 21 was completely removed by the cleaning paper.

On the other hand, in this embodiment, on both of the surface of the fixing film 21 and the surface of the pressing roller 22, the toner contaminant was little observed and 99% or more of the toner contaminant was removed. Further, with respect to 1% or less of the remaining toner contaminant, the toner contaminant was not deposited on the recording material during the normal image forming operation, so that it was possible to obtain an excellent cleaning effect.

(Action of First Cleaning Operation)

An object of the first cleaning operation is to selectively transfer the paper powder and the filler contained in the paper powder rich toner contaminant from the pressing roller surface onto the fixing film surface. Thereafter, the paper powder and the filler are intended to be discharged to the outside of the fixing device by melting and bonding thereof together with the solid image formed on the cleaning paper.

As a condition, in the first cleaning operation, for satisfying the above action, the relationship among the pressing roller surface temperature Tp, the toner deformation end point Tf2 and the toner flow start point during the idling of the fixing film is required to satisfy the following formula. That is, the temperature-control temperature during the idling in the first cleaning operation is required to be set so as to satisfy: Tf2≦Tp≦Tf3.

In the above condition, the temperature in the paper powder rich contaminant on the surface of the pressing roller is also not more than the deformation end point Tf2 and not more than the flow start point Tf3. That is, the temperature contained in the paper powder rich toner contaminant on the surface of the pressing roller is in a state in which the toner contaminant has a poor flowability as a whole although the flowability at a certain level or more is kept.

In such a state, when the toner contaminant receives the frictional force in the fixing nip N by the rotation of the pressing roller and the fixing film, shearing force such that a contact area between the toner component and the paper powder or filler component is decreased acts on the toner contaminant. That is, the toner component having high flowability is capable of being deformed by the shearing force but on the other hand, the paper powder or filler component which has low flowability and high rigidity cannot be deformed. Therefore, as a result, the contact area between the toner component and the paper powder or filler component is decreased.

The adhesive force between the toner component and the paper powder or filler component is proportional to their contact area. For that reason, when the contact area is decreased, the paper powder and the filler contained in the paper powder rich toner contaminant are dropped from the paper powder rich toner contaminant alone or in a state in which a slight amount of the toner is deposited on the paper powder or the filler.

Thus, most of the paper powder and the filler dropped from the pressing roller toner contaminant is transferred onto the surface of the fixing film 21. Thereafter, when the cleaning paper CP on which the solid image is carried is passed through the fixing nip N, the above-described paper powder and the filler are discharged to the outside of the fixing device F together with the melted solid image of the cleaning paper CP.

As described above, the pressing roller surface temperature Tp is controlled so as to be not less than the toner deformation end point Tf2 and not more than the flow start point Tf3 as in this embodiment. Then, in this state, the fixing film is idled for the predetermined time and thereafter the cleaning paper is passed through the fixing nip, so that the paper powder rich contaminant on the pressing roller surface can be transferred once on the fixing film surface.

Further, the reason why the idling of the fixing film 21 is started after the thermistor detection temperature becomes the normal temperature in the cleaning mode in this embodiment is that the idling of the fixing film 21 is intended to be started after the surface temperature Tp of the pressing roller 22 reliably becomes a temperature which is not more than the flow start point Tf3 of the toner. Even when the idling of the fixing film 21 is performed in the case where the surface temperature Tp of the pressing roller 22 is higher than the toner flow start point Tf3, as described in the result of Comparative Embodiment 3, the paper powder rich contaminant on the surface of the pressing roller 22 is less liable to be transferred onto the surface of the fixing film 21. For that reason, it becomes difficult to effectively remove the paper powder rich contaminant on the surface of the pressing roller 22.

Further, in the case where the surface temperature Th of the fixing film 21 is not less than the flow start point Tf3, the toner in the paper powder rich contaminant transferred on the surface of the fixing film 21 is heated to the flow start point Tf3 or more, so that the adhesive force of the toner to the contaminant on the surface of the pressing roller 22 is increased. For that reason, in many cases, the paper powder rich contaminant transferred on the surface of the fixing film 21 is transferred again onto the pressing roller 22. Therefore, in the cleaning mode, during the idling of the fixing film 21, it is preferable that the surface temperature Th of the fixing film 21 is not more than the toner flow start point Tf3(Th≦Tf3) as in this embodiment.

In the image forming apparatus in this embodiment, the controller C obtains the surface temperature Th of the fixing film 21 and the surface temperature Tp of the pressing roller 22 on the basis of the thermistor detection temperatures. Specifically, the controller C obtains the surface temperature Th of the fixing film 21 on the basis of the thermistor detection temperature by using a table or an operational expression prepared depending on a correlation between the thermistor detection temperature and the surface temperature Th of the fixing film 21. Similarly, the controller C obtains the surface temperature Tp of the pressing roller 22 on the basis of the thermistor detection temperature by using a table or an operational expression prepared depending on a correlation between the thermistor detection temperature and the surface temperature Tp of the pressing roller 22.

(Operation Order of First Cleaning Operation and Second Cleaning Operation)

The operation order of the first cleaning operation and the second cleaning operation will be described. A first object of determination of the order of the cleaning operations is to obtain the following action during the first cleaning operation. That is, the toner contaminant deposited on the fixing film surface can be removed and by performing the idling operation in the state in which the pressing roller surface temperature Tp satisfies: Tf2≦Tp≦Tf3, the toner contaminant on the pressing roller surface can be transferred onto the fixing film surface. As a result, the toner contaminant, which is particularly the paper powder rich toner contaminant, on the pressing roller surface can be removed at a side where the solid image on the cleaning paper is formed, i.e., a side where a higher toner contaminant removing effect is achieved. Further, also with respect to the toner contaminant on the pressing roller which cannot be completely transferred onto the fixing film surface by the first cleaning operation, by performing the second cleaning operation after the first cleaning operation, the toner contaminant can be removed substantially completely.

Further, a second object is, as described in Embodiment 1, to prevent further contamination of the cleaning paper, the fixing film surface and the pressing roller surface due to the hot-offset of the solid image formed on the cleaning paper.

As described above, the image forming apparatus in this embodiment successively performs, in the cleaning mode, the first cleaning operation and then the second cleaning operation. As a result, it is possible to obtain a further high removing effect with respect to the toner contaminant deposited on the fixing film surface and the pressing roller surface, particularly the paper powder rich toner contaminant.

Further, in the cleaning mode, the paper powder rich contaminant on the surface of the fixing film 21 is transferred onto the surface of the recording material to some extent even when the recording material, on which the solid image is not carried, used in the normal image forming operation. However, as in this embodiment, the case where the cleaning paper on which the solid image is carried is used is preferable since the paper powder rich contaminant on the surface of the fixing film 21 is smoothly transferred onto the recording material by the adhesive force of the toner of the unfixed toner image for cleaning. Further, also in the case where the recording material on which the solid image is not carried is passed through the fixing nip in the cleaning mode, the surface temperature Th of the fixing film 21 is made not less than the softening point Ts of the toner. As a result, the adhesive force of the toner, to the recording material, in the paper powder rich contaminant on the surface of the fixing film 21 can be increased. For that reason, when the recording material on which the solid image is not carried is passed through the fixing nip in the cleaning mode, the surface temperature Th of the fixing film 21 may preferably be not less than the softening point Is of the toner.

The action of the second cleaning operation in this embodiment is as described in Embodiment 1 but by the execution of the above-described first cleaning operation in this embodiment, it is possible to except particularly a synergistic effect on the cleaning performance as described below. The first cleaning operation is characterized in that the paper powder in a large amount is dropped from the paper powder rich toner contaminant which has been deposited on the pressing roller surface and then is transferred onto fixing film surface. For that reason, on the pressing roller surface immediately before the execution of the second cleaning operation, compared with the pressing roller surface before the execution of the operations in the cleaning mode, the toner contaminant with the toner ratio higher than the photosensitive drum ratio remains. Therefore, with respect to the second cleaning for cleaning the pressing roller surface in the cleaning area 2 of the cleaning paper, the toner contaminant with the higher toner ratio exhibits a larger adhesive force to the contact and a large permeation property into the cleaning paper. As a result, the toner contaminant on the surface of the pressing roller 22 can be removed efficiently.

Other Embodiments

1) The timing when the operations in the cleaning mode are executed is not limited to the time when the number of sheets passed through the fixing nip reaches 1000 sheets but may also be set at the time when the number of sheets reaches a desired number of sheets other than 1000 sheets.

2) In the above embodiments, the cleaning mode is applied to the image forming apparatus in which the fixing device including the pressing roller and the fixing film which is rotated by the rotation of the pressing roller is mounted. However, the cleaning mode may also be applied to the image forming apparatus in which the fixing device in which the pressing roller is rotated by the rotation of the fixing film is mounted. Or, the cleaning mode may be applied to the image forming apparatus in which the fixing device including the pressing roller and the fixing film which are independently rotated is mounted.

3) It is also possible to achieve similar action and effect even when the cleaning mode is applied to the image forming apparatus in which the fixing device of the heating roller type including the fixing roller (rotatable fixing member) and the pressing roller (pressing member) is used in place of the fixing device of the film heating type.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 105346/2010 filed Apr. 30, 2010, which is hereby incorporated by reference.

What is claimed is:

1. An image forming apparatus comprising:

an image forming portion for forming an unfixed toner image on a recording material; and a fixing portion for fixing the unfixed toner image on the recording material while conveying the recording material at a fixing nip, said fixing portion including a first rotatable member contactable to the unfixed toner image, and a second rotatable member contacted to the first rotatable member to form the fixing nip between the second rotatable member and the first rotatable member, wherein said image forming apparatus is capable of setting a cleaning mode in which said fixing portion is cleaned by a cleaning sheet while conveying the cleaning sheet at the fixing nip, and wherein when the cleaning mode is set, the image forming apparatus executes the following operations in a period in which a single cleaning sheet passes through the fixing nip:

preparation of the cleaning sheet carrying the unfixed toner image for cleaning by using said image forming portion, a first cleaning operation in which the cleaning sheet is conveyed while heating the unfixed toner image for cleaning, and a second cleaning operation, when an area of the cleaning sheet not carrying the unfixed toner image for cleaning is nipped at the fixing nip, of repeating a fixing nip heating operation and a fixing nip cooling operation in a stop state of the conveyance of the cleaning sheet while intermittently conveying the cleaning sheet.

2. An apparatus according to claim 1, wherein the first rotatable member is an endless belt, and wherein said fixing portion includes a heater to contact an inner surface of the endless belt and to press-contact the endless belt to the second rotatable member at the fixing nip.

3. An apparatus according to claim 2, the heater is controlled so that a temperature of the heater during the fixing nip heating operation of the second cleaning operation is higher than during the first cleaning operation.

4. An apparatus according to claim 3, the second cleaning operation is performed after the first cleaning operation.

5. An apparatus according to claim 1, wherein when the cleaning mode is set, the image forming apparatus provides a pre-heating period in which the first rotatable member and the second rotatable member are rotated in a state in which a heater provided at said fixing portion is controlled so that a surface temperature Tp of the second rotatable member immediately after passing through the fixing nip is kept within a temperature range of $Tf2 \leqq Tp \leqq Tf3$, and wherein Tf2 is a deformation end point of a toner and Tf3 is a flow start point of the toner, and after a lapse of the pre-heating period, the cleaning sheet is conveyed into the fixing nip to perform the first cleaning operation.

6. An image forming apparatus comprising:

an image forming portion for forming an unfixed toner image on a recording material; and a fixing portion for fixing the unfixed toner image on the recording material while conveying the recording material at a fixing nip, said fixing portion including a first rotatable member contactable to the unfixed toner image, a second rotatable member contacted to the first rotatable member to form the fixing nip between itself and the first rotatable member, and a heater to heat the first rotatable member, wherein said image forming apparatus is capable of setting a cleaning mode in which said fixing portion is cleaned by a cleaning sheet while conveying the cleaning sheet at the fixing nip, and wherein when the cleaning mode is set, the image forming apparatus executes the following operations in a period in which a single cleaning sheet passes through the fixing nip:

preparation of the cleaning sheet carrying the unfixed toner image for cleaning by using said image forming portion, a first cleaning operation in which the cleaning sheet is conveyed while heating the unfixed toner image for cleaning, and a second cleaning operation, when an area of the cleaning sheet not carrying the unfixed toner image for cleaning is nipped at the fixing nip, of repeating energization and deenergization of the heater in a stop state of the conveyance of the cleaning sheet while intermittently conveying the cleaning sheet.

7. An apparatus according to claim 6, wherein the first rotatable member is an endless belt, and wherein the heater is in contact with an inner surface of the endless belt and press-contacts the endless belt to the second rotatable member at the fixing nip.

8. An apparatus according to claim 6, wherein when the cleaning mode is set, the image forming apparatus provides a pre-heating period in which the first rotatable member and the second rotatable member are rotated in a state in which the heater is controlled so that a surface temperature Tp of the second rotatable member immediately after passing through the fixing nip is kept within a temperature range of $Tf2 \leqq Tp \leqq Tf3$, and wherein Tf2 is a deformation end point of a toner and Tf3 is a flow start point of the toner, and after a lapse of the pre-heating period, the cleaning sheet is conveyed into the fixing nip to perform the first cleaning operation.

9. An apparatus according to claim 6, the heater is controlled so that a temperature of the heater during the second cleaning operation is higher than a temperature of the heater during the first cleaning operation.

10. An apparatus according to claim 9, the second cleaning operation is performed after the first cleaning operation.

* * * * *